US006595021B2

(12) United States Patent
Skinner

(10) Patent No.: US 6,595,021 B2
(45) Date of Patent: Jul. 22, 2003

(54) ICE CUBE CATCHER

(76) Inventor: Chuck Skinner, 905 Tartan Trail, Bloomfield Hills, MI (US) 48304

( * ) Notice: Subject to any disclaimer, the term of this patent is extended or adjusted under 35 U.S.C. 154(b) by 0 days.

(21) Appl. No.: 10/037,830

(22) Filed: Jan. 3, 2002

(65) Prior Publication Data

US 2002/0083729 A1 Jul. 4, 2002

Related U.S. Application Data

(60) Provisional application No. 60/259,530, filed on Jan. 3, 2001.

(51) Int. Cl.[7] ..... F25B 17/00; F25C 5/18

(52) U.S. Cl. ..... 62/344; 62/377

(58) Field of Search ..... 62/344, 377, 441; 222/146.6; 312/401, 405.1

(56) References Cited

U.S. PATENT DOCUMENTS

| | | | | |
|---|---|---|---|---|
| 3,216,213 A | * | 11/1965 | Eschenburg et al. | 62/137 |
| 3,226,939 A | * | 1/1966 | Harbison et al. | 62/177 |
| 3,537,132 A | * | 11/1970 | Alvarez | 62/266 |
| 3,744,270 A | * | 7/1973 | Wilcox | 62/344 |
| 3,877,767 A | | 4/1975 | Bright | 312/337 |
| 3,883,204 A | | 5/1975 | Prada et al. | 312/273 |
| 3,998,069 A | | 12/1976 | Kronenberger et al. | 62/288 |
| 4,087,140 A | | 5/1978 | Linstromberg | 312/292 |
| 5,033,273 A | * | 7/1991 | Buchser et al. | 200/332.1 |
| 5,273,354 A | | 12/1993 | Herrmann et al. | 312/408 |
| 5,474,213 A | * | 12/1995 | Unger | 141/86 |
| 5,516,204 A | | 5/1996 | Calvert et al. | 312/408 |
| 5,806,333 A | | 9/1998 | Kim et al. | 62/353 |
| 5,886,430 A | * | 3/1999 | Ralson et al. | 307/112 |
| 6,050,097 A | * | 4/2000 | Nelson et al. | 62/137 |
| 6,082,130 A | * | 7/2000 | Pastryk et al. | 222/146.6 |
| 6,148,624 A | * | 11/2000 | Bishop et al. | 62/137 |

OTHER PUBLICATIONS

Deflecto Corporation Technical Product Specifications, Economy Air Deflector Model 101 (2001).

Deflecto Corporation Technical Product Specifications, Unbreakable Air Deflector Model 50 (2001).

* cited by examiner

*Primary Examiner*—William E. Tapolcal
*Assistant Examiner*—Mohammad M. Ali
(74) *Attorney, Agent, or Firm*—Gifford, Krass, Groh, Sprinkle, Anderson & Citkowski, P.C.

(57) ABSTRACT

The present invention is directed to an ice cube catcher that is attachable to a refrigerator door to catch ice cubes dispensed from the outlet of the dispenser. Preferably, the ice cube catcher includes a body that has a lower integral portion and two end portions. The integral portion and ends contact the refrigerator once the catcher is mounted on the refrigerator door. The body may be a single piece construction or be constructed of two body members that are joined together in a telescopic fashion such that the length of the catch can be adjusted to accommodate different size ice cube dispensers. The ends of the body have flanges or protrusions upon which are secured magnets or other types of attachment fixtures for mounting the catcher onto the refrigerator.

20 Claims, 3 Drawing Sheets

ICE CUBE CATCHER

CROSS-REFERENCE TO RELATED APPLICATIONS

The present invention claims priority from U.S. provisional application No. 60/259,530, filed Jan. 3, 2001 for an Ice Cube Catcher, said provisional application being incorporated herein by reference in its entirety.

BACKGROUND OF THE INVENTION

1. Field of the Invention

The present invention is directed to a device for catching ice cubes. More particularly, the present invention concerns a device for catching ice cubes that might otherwise fall from an ice cube dispenser located in the door of a refrigerator onto a floor.

2. Reference to Related Art

Refrigerators provided with an ice cube dispenser usually include a discharge opening in the door of the refrigerator or on the front face of the refrigerator. The discharge opening of the dispenser may include a small shelf to catch the ice cubes that are discharged from the dispenser and which are not caught by the glass or the like which is intended to receive them. Such shelves, if provided, do not include a front barrier. Therefore, they are largely ineffective in preventing ice cubes from falling to the floor.

SUMMARY OF THE INVENTION

The present invention provides an ice cube catcher designed to be mounted to a refrigerator to catch and retain ice cubes that would ordinarily fall to the floor from an ice cube dispenser. In a preferred embodiment, the ice cube catcher includes a body that has a lower portion extending inwardly toward the refrigerator door when the catcher is mounted on a refrigerator and a pair of inwardly curved end portions. Each of the end portions includes a flange or protrusion upon which is secured an attachment means for removably mounting the body to the refrigerator door. The attachment means is preferably a magnetic tape. However, mounting tape, two-sided sticky tape, hook and loop fasteners (e.g., VELCRO®) may also be used to mount the ice cube catcher to the refrigerator.

In a first alternative embodiment, the body of the ice cube catcher includes a first and a second body member that are telescopically joined together to permit longitudinal adjustment of the body. Therefore, the length of the catcher is adjustable to accommodate different size ice cube dispensers.

Finally, in a second alternative embodiment, the first body member is modified to include a raised center face and a pair of side faces. The center face and the side faces function to direct ice back into a recess of the dispenser. The center face preferably extends in a tapering fashion from the lower integral portion to proximate an upper edge of the first body member. The side faces preferably extend from opposite sides of the center face.

The ice cube catcher of the present invention is preferably constructed of clear plastic but it will be apparent that it could be of any color and that other materials could be used.

BRIEF DESCRIPTION OF THE DRAWINGS

Reference will now be made to the accompanying drawings, wherein like reference numerals refer to like parts throughout, and which will provide the reader with a clearer understanding of the present invention.

DETAILED DESCRIPTION

Figure 1:
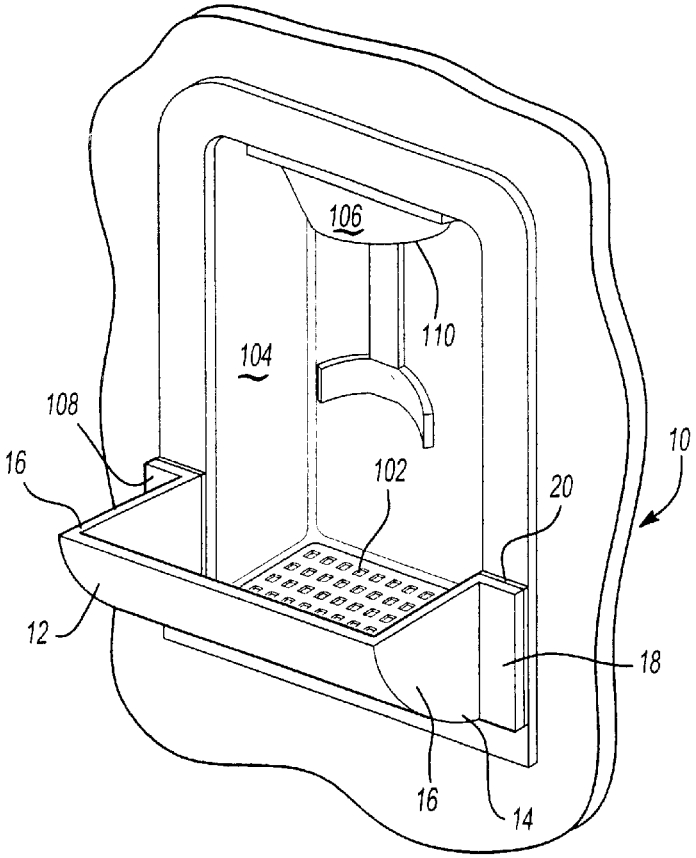
FIG. 1, is a perspective view of the ice cube catcher of the present invention secured to a refrigerator door proximate an ice cube dispenser.
Figure 2:
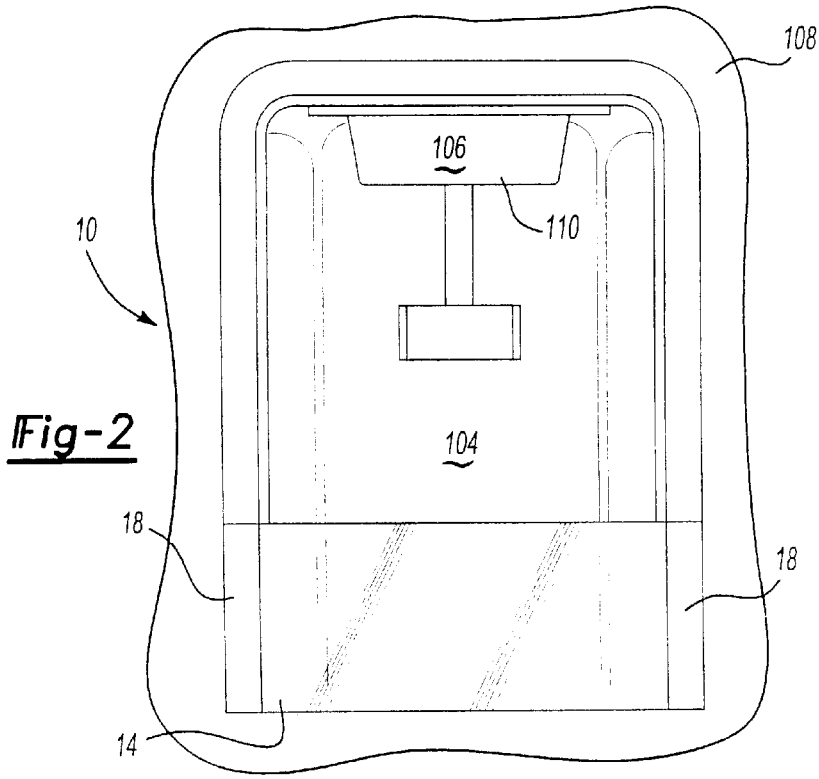
FIG. 2, is a planar front view of the ice cube catcher of the present invention secured to a refrigerator door.

Referring now to FIGS. 1, and 2 there is shown a preferred embodiment of an ice cube catcher 10 constructed in accordance with the present invention. Preferably, the ice cube catcher 10 includes an elongated body 12 having a lower integral portion 14 and integrally formed ends 16. The ends 16 are curved inwardly and have flanges 18 or protrusions onto which are secured attachment means 20 for mounting the catcher 10 to a refrigerator 100. The lower integral portion 14 is also preferably inwardly curved to engage the refrigerator 100 upon mounting of the catcher 10 to the refrigerator 100.

Preferably, the ice cube catch 10 is affixed to a refrigerator 100 by fitting the catcher 10 over the lower portion 102 of a recess 104 of an ice cube dispenser 106 that is provided in a door 108 of the refrigerator 100. Therefore, the catcher 10 is positioned to catch ice cubes (not shown) that are dispensed from the outlet 110 of the dispenser 106.

Still referring to FIGS. 1 and 2, the body 12 of the catcher 10 is preferably constructed as a solid piece of transparent plastic. However, it will appreciated that other materials such as glass, plexiglas, fiberglass, aluminum or stainless steel can be used to construct a catcher 10 according to the present invention. The attachment means 20 of the present invention are preferably a magnetic tape. However, mounting tape, two-sided sticky tape, hook and loop fasteners (e.g., VELCRO®) may also be used to mount the catcher 10 to the refrigerator 100. Alternatively, the door 108 of the refrigerator 100 can include slots 110 to slidably engage the flanges 18 of the ends 16 and support the catcher 10 on the refrigerator 100. As a still further alternative, the ends 16 of the catcher 10 may be adapted to resiliently or fictionally (e.g., pads on disposed on the ends 16) engage the sides of the recess 114 to mount the ice cube catcher 10 in place.

Figure 3:
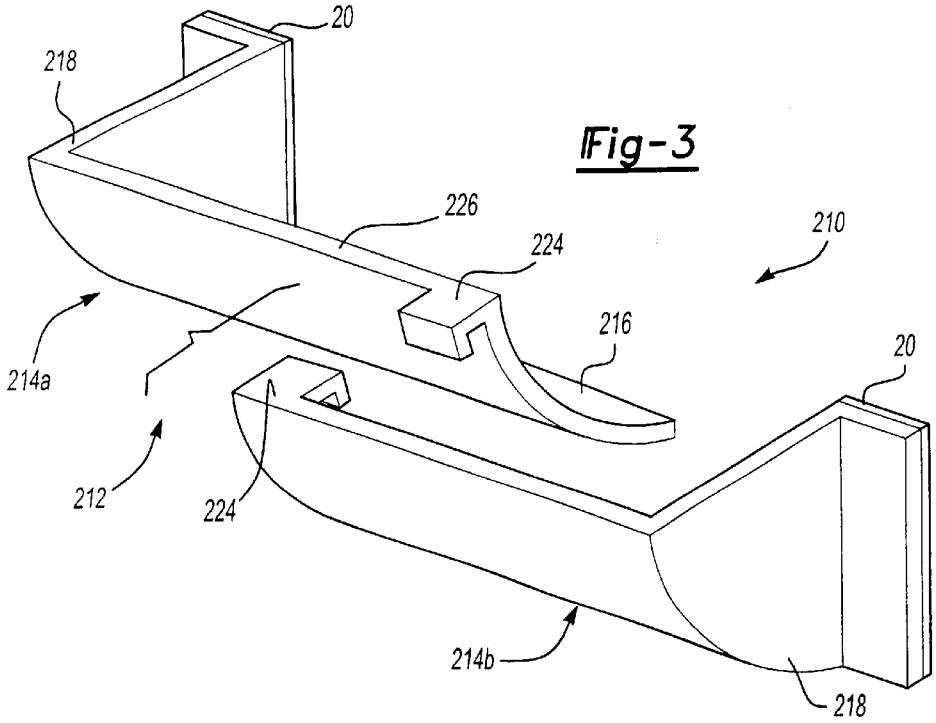
FIG. 3 is an exploded perspective view of a first alternative embodiment of the present invention showing a first and second body member telescopically attached.
Figure 4:
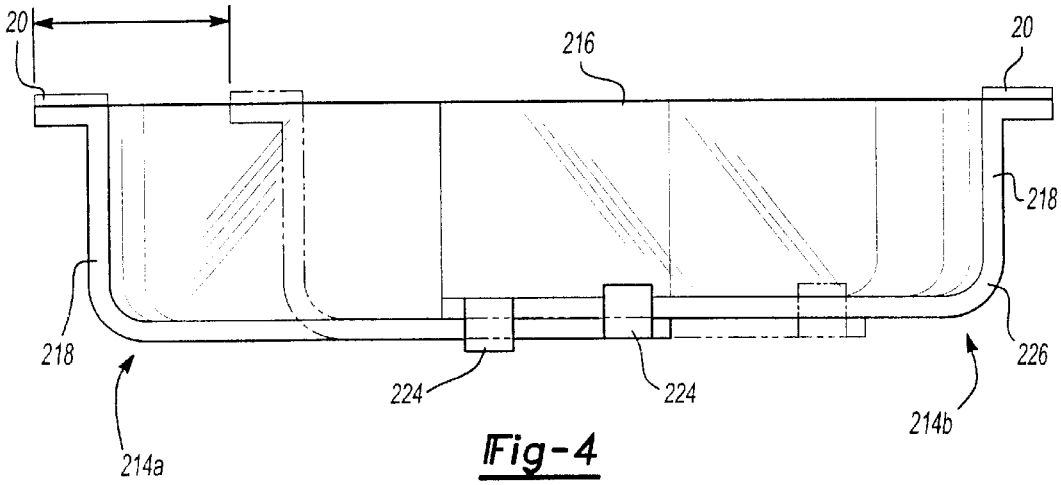
FIG. 4, is a top planar view of the first alternative embodiment of the present invention.

Referring now to FIGS. 3 and 4, there is shown a first alternative embodiment of an ice cube catcher 210 constructed in accordance with the present invention. The ice cube catcher 210 includes a body 212 having a first 214*a* and a second 214*b* body member. Each body member 214*a*, 214*b* includes a lower integral portion 216 and integrally formed ends 21 8. The ends 218 are curved inwardly and have flanges 220 or protrusions onto which are secured attachment means 20 for mounting the catcher 210 to a refrigerator (not shown). The lower integral portion 216 is also preferably inwardly curved to engage the refrigerator upon mounting of the catcher 210 to the refrigerator.

A support member 224 (e.g., a catch) is integrally formed along an upper edge 226 of the first 214*a* and second 214*b* body member. Preferably, the support member 224 of each of the body members 214*a*, 214*b* are adapted to slidably engage the upper edge 226 of the other body member in order to telescopically join the two body members 214*a*, 214*b*. Therefore, it will be appreciated that the overall length of the ice cube catcher 210 is adjustable to accommodate the ice cube dispenser 106 of different makes or models of refrigerators with differently configured outlets.

Figure 5:
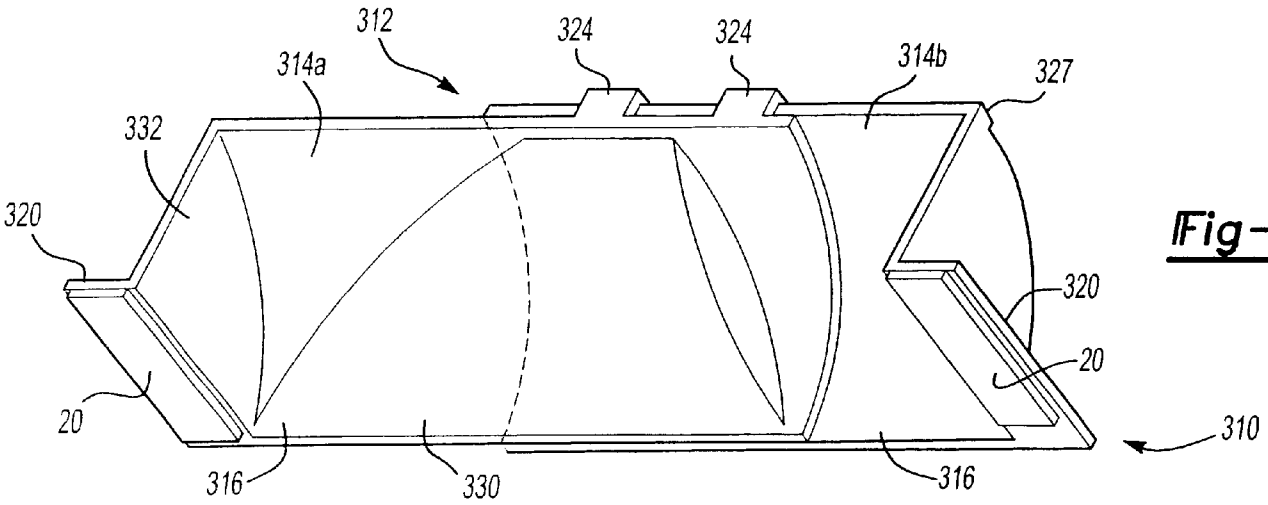
FIG. 5, is a perspective view of a second alternative embodiment of the present invention showing a first body member having a raised inner surface.
Figure 6:
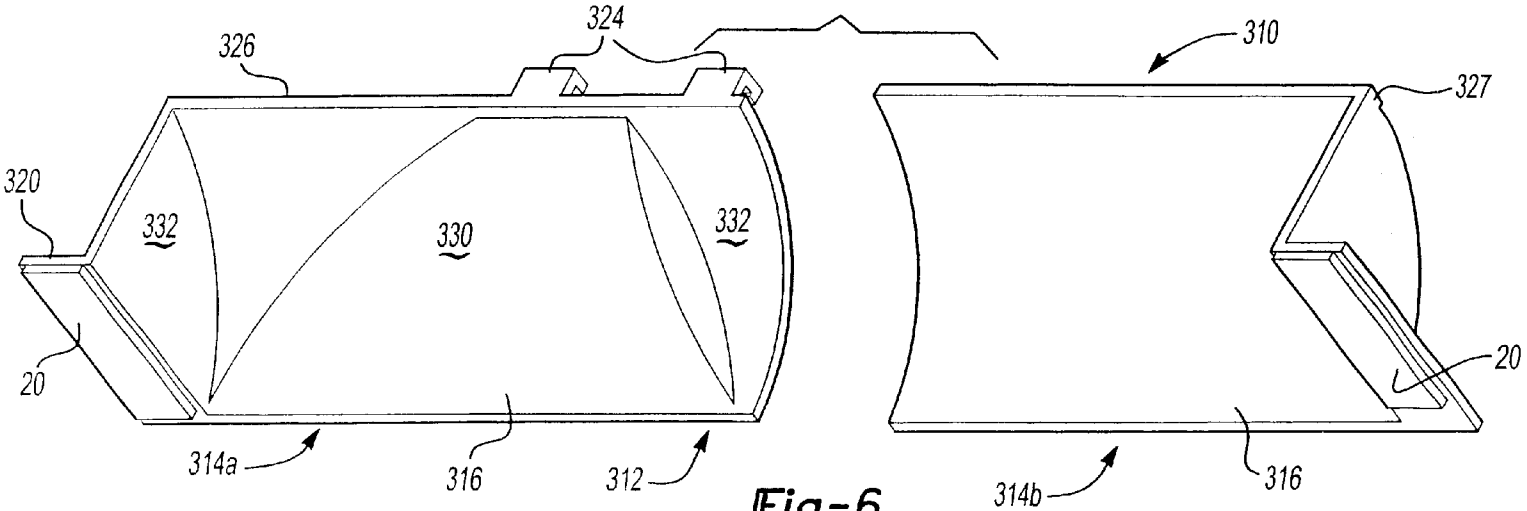
FIG. 6, is an exploded perspective view of the second alternative embodiment.

Referring now to FIGS. 5 and 6, there is shown a second alternative embodiment of an ice cube catcher 310 constructed in accordance with present invention. The ice cube catcher 310 includes a body 312 having a first 314*a* and a second 314*b* body member. Each body member 314*a*, 314*b* includes a lower integral portion 316 and integrally formed ends 318. The ends 318 are curved inwardly and have flanges 320 or protrusions onto which are secured attachment means 20 for mounting the catcher 310 to a refrigerator (not shown). The lower integral portion 316 is also preferably inwardly curved to engage the refrigerator upon mounting of the catcher 310 to the refrigerator. A pair of support members 324 (e.g., hooks) are integrally formed along an upper edge 326 of the first body member 314*a*. The support members 324 are adapted to slidably engage a ridge 327 of the upper edge 328 of the second body member 314*b* in order to telescopically join the two body members 314*a*, 314*b*.

Preferably, an inner surface 328 of the first body member 314*a* includes a raised center face 330 and a pair side faces 332. The center face 330 and side faces 332 function to direct ice cubes back into the recess 104 of the dispenser 106. The center face 330 preferably extends in a tapering fashion from the lower integral portion 316 to proximate the upper edge 326 of the first body member 314*a*. The side faces 332 preferably extend from opposite sides of the center face 332. It will also be appreciated that the overall length of the ice cube catcher 310 is adjustable to accommodate the ice cube dispenser 106 (FIG. 1) of different makes or models of refrigerators with differently configured outlets.

Having thus described my invention, it will be apparent to the skill artisan that many modifications and changes can be made to the above embodiments without departing from the spirit of the invention.

I claim:

1. An ice cube catcher for attachment to a door of a refrigerator to catch ice cubes dispensed from an outlet of an ice cube dispenser mounted within said door, said catcher comprising:

a body, said body having a lower portion that extends inwardly toward said refrigerator door when said catcher is mounted on the refrigerator door and inwardly curved end portions, said end portions each having a flange; and attachment means secured to said flange for removably mounting said body to said refrigerator door.

2. The ice cube catcher of claim 1, wherein said body comprises a first and a second body member, said first and second body member being telescopically joined together to permit longitudinal adjustment of the body such that the length of the catcher is adjustable to accommodate different size ice cube dispensers.

3. The ice cube catcher of claim 2, wherein said first body member has at least one support member, said support member being adapted to slidably engage said second body member.

4. The ice cube catcher of claim 2, wherein said support member comprises a catch.

5. The ice cube catcher of claim 2, wherein said support member comprises a hook.

6. The ice cube catcher of claim 2, wherein said first body member comprises a raised center face and a pair of side faces.

7. The ice cube catcher of claim 3, wherein said first body member comprises a raised center face and a pair of side faces.

8. The ice cube catcher of claim 1, wherein said attachment means comprises a magnet.

9. The ice cube catcher of claim 1, wherein said attachment means comprises a mounting tape.

10. The ice cube catcher of claim 1, wherein said attachment means comprises two-side sticky tape.

11. The ice cube catcher of claim 1, wherein said attachment means comprises a hook and loop fastener.

12. An ice cube catcher for attachment to a door of a refrigerator to catch ice cubes dispensed from the outlet of an ice cube dispenser mounted with said door, said catcher comprising:

a body having first and second body members, said first and second body members each having a lower portion that extends inwardly toward said refrigerator door when said catcher is mounted on a refrigerator door and an inwardly curved end portion, each end portion each having a flange, said first body member also having a raised center face and a pair of side faces and at least one hook, said hook adapted to slidably engage an upper edge of said second body member such that said first and second body members are telescopically joined together to permit longitudinal adjustment of the body such that the length of the catcher is adjustable to accommodate different size ice cube dispensers; and attachment means secured each flange for removably attaching said body to said refrigerator door, said attachment means comprising a magnet.

13. An ice cube catcher for attachment to a door of a refrigerator to catch ice cubes dispensed from an outlet of an ice cube dispenser mounted within said door, the combination comprising:

a refrigerator, said refrigerator having a door;

an ice cube dispenser mounted within said door of the refrigerator, said ice cube dispenser having an outlet for dispensing ice cubes and a lower portion; and an ice cube catcher for catching ice cubes dispensed from said outlet within the dispenser, said catcher having a body, said body having a lower portion that extends inwardly toward said refrigerator door when said catcher is mounted on the refrigerator door and end portions, said end portions each having a flange; and attachment means secured to said flange for removably mounting said body of said catcher to said refrigerator door.

14. The ice cube catcher of claim 13, wherein said body of said catcher further comprises a first and a second body member, said first and second body member being telescopically joined together to permit longitudinal adjustment of the body such that the length of the catcher is adjustable to accommodate different size ice cube dispensers.

15. The ice cube catcher of claim 14, wherein said first body member has at least one support member, said support member being adapted to slidably engage said second body member.

16. The ice cube catcher of claim 15, wherein said support member comprises a catch.

17. The ice cube catcher of claim 15, wherein said support member comprises a hook.

18. The ice cube catcher of claim 13, wherein said attachment means comprises a magnet.

19. The ice cube catcher of claim 13, wherein said attachment means comprises a mounting tape.

20. An ice cube catcher for attachment to a door of a refrigerator to catch ice cubes dispensed from an outlet of an ice cube dispenser mounted within said refrigerator door, said catcher comprising:

a body having a pair of ends and an elongated body portion extending between said ends, said elongated body portion including a lower edge and an upper edge, said ends extending away from said refrigerator door when said body is mounted on said refrigerator door, said elongated body portion extending upwardly from said lower edge and said upper edge of said body being spaced away from said refrigerator door when said body is mounted on said refrigerator door proximate said ice cube dispenser so as inhibit the fall of ice cubes generated by said dispenser onto a floor; and attachment means for mounting said body to said refrigerator door.

* * * * *

UNITED STATES PATENT AND TRADEMARK OFFICE

CERTIFICATE OF CORRECTION

PATENT NO. : 6,595,021 B2
DATED : July 22, 2003
INVENTOR(S) : Chuck Skinner

It is certified that error appears in the above-identified patent and that said Letters Patent is hereby corrected as shown below:

Title page,
Item [75], Inventor, replace "Chuck Skinner" with -- Charles J. Skinner --.

Column 2,
Line 59, replace "21 8" with -- 218 --.

Signed and Sealed this

Twenty-seventh Day of July, 2004

JON W. DUDAS
*Acting Director of the United States Patent and Trademark Office*